US007102611B2

(12) United States Patent
Chung et al.

(10) Patent No.: US 7,102,611 B2
(45) Date of Patent: Sep. 5, 2006

(54) CHIP-ON-GLASS TYPE LIQUID CRYSTAL DISPLAY

(75) Inventors: Kyung Hoon Chung, Kyoungki-do (KR); Nak Hyun Sung, Seoul (KR)

(73) Assignee: Boe-Hydis Technology Co., Ltd., Kyoungki-do (KR)

( * ) Notice: Subject to any disclaimer, the term of this patent is extended or adjusted under 35 U.S.C. 154(b) by 453 days.

(21) Appl. No.: 10/620,716

(22) Filed: Jul. 16, 2003

(65) Prior Publication Data

US 2004/0085281 A1 May 6, 2004

(30) Foreign Application Priority Data

Nov. 4, 2002 (KR) ..... 10-2002-0067817

(51) Int. Cl.
*G09G 3/36* (2006.01)

(52) U.S. Cl. ..... 345/98; 345/87; 345/95; 345/100; 345/104

(58) Field of Classification Search ..... 345/87–104
See application file for complete search history.

(56) References Cited

U.S. PATENT DOCUMENTS 6,388,652 B1 * 5/2002 Yamazaki et al. ..... 345/98
6,624,857 B1 * 9/2003 Nagata et al. ..... 349/54
6,756,959 B1 * 6/2004 Fujino ..... 345/95
6,778,164 B1 * 8/2004 Yamazaki et al. ..... 345/98
2005/0017940 A1 * 1/2005 Yamazaki et al. ..... 345/98

* cited by examiner

*Primary Examiner*—Vijay Shankar
(74) *Attorney, Agent, or Firm*—Ladas & Parry LLP

(57) ABSTRACT

Disclosed is a chip-on-glass type liquid crystal display (LCD). The LCD is directed to provide a construction in a way that, while each wiring for supplying driver circuits with a driving voltage is directly formed on an LCD panel through application of COG (Chip-On-Glass) technology for producing TFT-LCD, even though the wirings are connected in series between the driver circuits, the driving voltage capable of normally operating the driver circuits is supplied to all driver circuits. To this end, in consideration of a voltage drop at the panel wiring, by increasing and outputting a driving voltage, the driving voltage inputted into an $n^{th}$ driver circuit is made to be equal to the driving voltage inputted into an $(n+1)^{th}$ driver circuit. To accomplish this object, a driving voltage generating section is provided to each driver IC, and comprises a charge pumping circuit for increasing the leading gate driving voltage to a predetermined level, and a buffer circuit for stabilizing an output voltage of the charge pumping circuit.

6 Claims, 2 Drawing Sheets

CHIP-ON-GLASS TYPE LIQUID CRYSTAL DISPLAY

BACKGROUND OF THE INVENTION

1. Field of the Invention

The present invention relates to a liquid crystal display (LCD), and more particularly to a chip-on-glass type liquid crystal display in which each wiring for driver circuits is directly formed on an LCD panel.

2. Description of the Prior Art

An active matrix type LCD includes a plurality of thin film transistors (hereinafter, referred to as "TFTs"), which are located around intersectional points between a plurality of scan lines and a plurality of signal lines, and by which a plurality of liquid crystal pixels are driven. The scan lines are each connected to an external gate driver IC, which provides scan signals. The signal lines are each connected to an external source driver IC, which provides image signals. When the image signals inputted from the source driver IC are applied to liquid crystals through the TFTs turned on by the scan signals, a designated image is displayed.

There are various methods of connecting the scan lines to the gate driver IC and of connecting the signal lines to the source driver IC, for example, TAB (Tape Automated Bonding) using a printed circuit board, and chip-on-glass (hereinafter, referred to as "COG"). In the COG method, both a gate driver IC and a source driver IC are directly attached onto an LCD panel by soldering or a metallic paste, and similarly each wiring for the gate driver IC and the source driver IC is directly performed on the LCD panel. In general, the wiring formed directly on the panel by application of this COG technology is referred to as "panel wiring". Herein, the gate driver IC and the source driver IC are together generically referred to as a "driver circuit". Further, a voltage applied to each driver circuit in order to drive the driver circuit is called a "driving voltage".

FIG. 1 shows how a driving voltage is applied to respective driver circuits 102, 104 and 106 through each panel wiring between the driver circuits. Each panel wiring can be modeled into resistors $R_{n-1}$ and $R_n$. As shown in FIG. 1, when the panel wirings $R_{n-1}$ and $R_n$ for supplying the driving voltage to the driver circuits 102, 104 and 106 are connected in series between the driver circuits 102, 104 and 106, a voltage drop is generated by internal resistance components of the driver circuits 102, 104 and 106 and by resistance components of the panel wirings $R_{n-1}$ and $R_n$. Owing to this voltage drop, a relationship as the following Formula 1 is established:

$$Vo(n-1)>Vi(n)>Vo(n)>Vi(n+1) \qquad \text{Formula 1}$$

where Vi(n) is the input driving voltage applied to the driver circuit 104 in reality, and Vo(n) is the output driving voltage outputted from the driver circuit 104 in order to drive next circuit.

For this reason, when several driver circuits are connected with each other, an input driving voltage applied actually to a driver circuit after a certain step drops less than the minimum voltage (referred to as an "operation voltage") necessary to operate the driver circuit, so that the circuit may not perform normal operation.

SUMMARY OF THE INVENTION

Accordingly, the present invention has been made to solve the above-mentioned problems occurring in the prior art, and an object of the present invention is to provide a chip-on-glass type liquid crystal display (LCD) having a type of construction in that while each wiring for supplying driver circuits with a driving voltage is directly formed on an LCD panel through application of COG (Chip-On-Glass) technology for producing TFT-LCD, even though the wirings are connected in series between the driver circuits, the driving voltage capable of normally operating the driver circuits is supplied to all driver circuits.

To this end, the present invention is designed so that, in consideration of a voltage drop at the panel wiring, by increasing and outputting a driving voltage, the driving voltage inputted into an nth driver circuit is made to be equal to the driving voltage inputted into an $(n+1)^{th}$ driver circuit.

In order to accomplish this object, there is provided a chip-on-glass type liquid crystal display (LCD) comprising: an LCD panel having a plurality of pixels; a plurality of source driving sections connected in series by first panel wiring formed on the LCD panel, supplied with a driving voltage through the first panel wiring, generating contrast voltages corresponding to data to be displayed on the LCD panel, and providing the generated contrast voltages to the LCD panel; and a plurality of gate driving sections connected in series by second panel wiring formed on the LCD panel, supplied with a driving voltage through the second panel wiring, and scanning the plurality of pixels of the LCD panel sequentially row by row, wherein each of the plurality of source driving sections increases and outputs an inputted source driving voltage to make a leading source driving voltage equal to a trailing source driving voltage, while each of the plurality of gate driving sections increases and outputs an inputted gate driving voltage to make a leading gate driving voltage equal to a trailing gate driving voltage.

Preferably, each of the gate driving sections comprises a charge pumping circuit for increasing the leading gate driving voltage to a predetermined level, and a buffer circuit for stabilizing an output voltage of the charge pumping circuit.

It is also preferred that each of the source driving sections comprises a charge pumping circuit for increasing the leading source driving voltage to a predetermined level, and a buffer circuit for stabilizing an output voltage of the charge pumping circuit.

It is preferred that the buffer circuit connects two CMOS (Complementary Metal Oxide Semiconductors) inverters in series, and makes use of the output voltage of the charge pumping circuit as an input voltage and a driving voltage of the buffer circuit. Further, by increasing and outputting the driving voltage higher than the original driving voltage, and then by adjusting resistance values of the panel wirings in the process, an nth driving voltage is made to be equal to an $(n+1)^{th}$ driving voltage.

According to this construction of the present invention, there is no possibility that due to a voltage drop, trailing driver circuits are not operated. Further, there is an advantage in that there is no restriction on the number of serial connected driver circuits.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
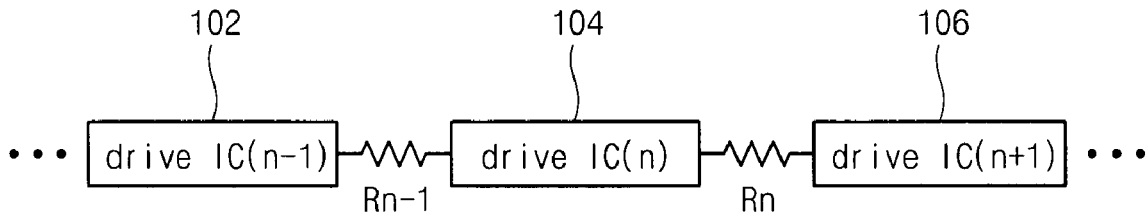
FIG.1 (PRIOR ART)
FIG. 1 is a view for explaining a connection between driver circuits in a liquid crystal display.

Hereinafter, a preferred embodiment of the present invention will be described in detail with reference to the accompanying drawings. For a consistent description, the same reference numerals are used to designate the same or similar elements or signals.

Figure 2:
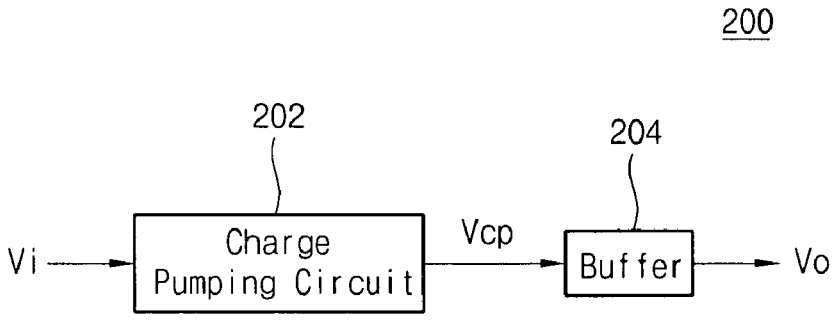
FIG. 2 is a block diagram of a driving voltage generating section according to one embodiment of the present invention.

FIG. 2 is a block diagram of a driving voltage generating section according to one embodiment of the present invention. As shown in FIG. 2, the driving voltage generating section 200 having a charge pumping circuit 202 and a buffer circuit 204 is provided to each driver IC.

The charge pumping circuit 202 increases a driving voltage Vi applied from a leading driver IC to a predetermined level and then outputs the increased driving voltage as a voltage Vcp. The charge pumping circuit 202 has been already widely known in the art, and thus its specific construction will not be disclosed herein. The buffer circuit 204 generates a voltage Vo by stabilizing the voltage Vcp outputted from the charge pumping circuit 202, and then outputs the voltage Vo to a next circuit.

Figure 3:
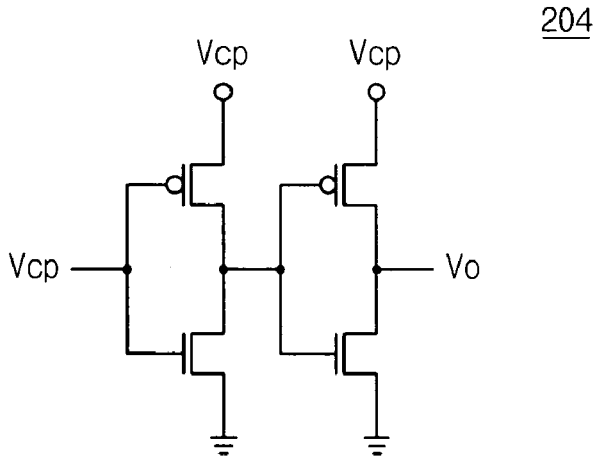
FIG. 3 shows a circuit of one example of the buffer circuit shown in FIG. 2.

FIG. 3 shows a circuit of one example of the buffer circuit shown in FIG. 2. As shown in FIG. 3, the buffer circuit 204 can be constructed by two CMOS (Complementary Metal Oxide Semiconductor) inverters, which are connected with each other in series. In order to output the voltage Vcp increased by the charge pumping circuit 202, the voltage Vcp functions as a driving voltage and an input voltage of the buffer circuit 204. The buffer circuit 204 is constructed as the CMOS circuit to output the voltage Vcp without a loss.

Figure 4:
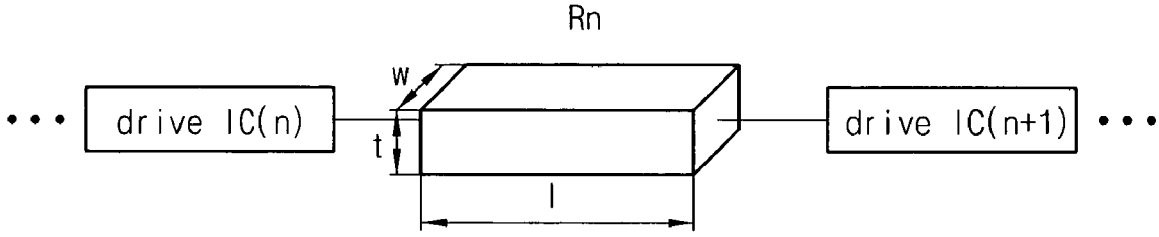
FIG. 4 is a view for explaining a resistance value of a panel wiring according to the present invention.

FIG. 4 is a view for explaining a resistance value of panel wiring according to the present invention. In FIG. 4, a resistance $R_n$ is represented as in Formula 2 as follows:

$$Rn=\rho*\lambda/(w*t) \qquad \text{Formula 2}$$

where ρ is the specific resistance, l is the length, w is the width, and t is the thickness.

As mentioned above, in consideration of a voltage drop at the panel wiring, by previously increasing and outputting the voltage, and additionally by adjusting l, w and t of the panel wiring through a process technique, the voltage dropped by the panel wiring is adjusted, and thereby consequently Vi(n) is allowed to be equal to Vi(n+1).

That is, according to the present invention, by providing the foregoing driving voltage generating section 200 (FIG. 2) inside the $n^{th}$ driver IC, after outputting the voltage increased higher than the inputted driving voltage, by a proper adjustment of a resistance value of the panel wiring in the process, a gate and source driving voltage applied to $n^{th}$ driver ICs, i.e., leading gate and source driver ICs is adapted to be equal to a gate and source driving voltage applied to $(n+1)^{th}$ driver ICs, i.e., trailing gate and source driver ICs.

According to this construction of the present invention, there is no possibility that due to a voltage drop, trailing driver circuits are not operated. Further, there is an advantage in that there is no restriction on the number of serial connected driver circuits.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A chip-on-glass type liquid crystal display (LCD), comprising:

an LCD panel having a plurality of pixels;

a plurality of source driving sections connected in series by first panel wiring formed on the LCD panel, a first source driving section of said plurality of source driving sections being a leading source driving section that is supplied with a source driving voltage through the first panel wiring, generating contrast voltages corresponding to data to be displayed on the LCD panel, and providing the generated contrast voltages to pixels of the LCD panel, said first source driving section also outputting a driving voltage to a second source driving section that is a trailing source driving section; and a plurality of gate driving sections connected in series by second panel wiring formed on the LCD panel, said plurality of gate driving sections including a first pate driving section being a leading gate driving section that is supplied with a gate driving voltage through the second panel wiring, and scanning the plurality of pixels of the LCD panel sequentially row by row, said first gate driving section also outputting a driving voltage to a trailing gate driving section wherein each of the plurality of source driving sections increases the source driving voltage to make a leading source driving voltage equal to a trailing source driving voltage, and wherein each of the plurality of gate driving sections increases the gate driving voltage to make a leading gate driving voltage equal to a trailing gate driving voltage.

2. A chip-on-glass type LCD as claimed in claim 1, wherein each of the gate driving sections comprises a charge pumping circuit for increasing the leading gate driving voltage to a predetermined level, and a buffer circuit for stabilizing an output voltage of the charge pumping circuit.

3. A chip-on-glass type LCD as claimed in claim 1, wherein each of the source driving sections comprises a charge pumping circuit for increasing the leading source driving voltage to a predetermined level, and a buffer circuit for stabilizing an output voltage of the charge pumping circuit.

4. A chip-on-glass type LCD as claimed in claim 2 or 3, wherein the buffer circuit includes two CMOS (Complementary Metal Oxide Semiconductors) inverters connected with each other in series; and wherein the output voltage of the charge pumping circuit is used as an input voltage and a driving voltage of the buffer circuit.

5. A chip-on-glass type LCD as claimed in claim 2, wherein the first panel wiring has a resistance value adjusted according to an output voltage of the buffer circuit and process parameters of a length, a width and a thickness of the first panel wiring.

6. A chip-on-glass type LCD as claimed in claim 3, wherein the second panel wiring has a resistance value adjusted according to an output voltage of the buffer circuit and process parameters of a length, a width and a thickness of the second panel wiring.

* * * * *